US006500595B1

(12) United States Patent
Mochizuki et al.

(10) Patent No.: US 6,500,595 B1
(45) Date of Patent: Dec. 31, 2002

(54) CARRIER FOR ELECTROPHOTOGRAPHIC DEVELOPER, METHOD FOR MANUFACTURING THE CARRIER, AND COATING LIQUID FOR THE METHOD

(75) Inventors: Satoshi Mochizuki, Numazu (JP); Yasuo Asahina, Numazu (JP); Kohsuke Suzuki, Shizuoka-ken (JP); Tomomi Suzuki, Gotenba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/692,430

(22) Filed: Oct. 20, 2000

(30) Foreign Application Priority Data

| | | |
|---|---|---|
| Oct. 20, 1999 | (JP) | 11-298890 |
| Oct. 20, 1999 | (JP) | 11-298891 |
| Oct. 20, 1999 | (JP) | 11-298893 |
| Mar. 14, 2000 | (JP) | 2000-069690 |

(51) Int. Cl.[7] ..... G03G 9/113

(52) U.S. Cl. ..... 430/111.1; 430/111.35; 430/137.13; 525/328.8; 525/375

(58) Field of Search ..... 430/111.1, 111.2, 430/111.3, 111.31, 111.32, 111.35, 111.34, 137.13, 137.12, 137.11, 137, 108, 111.33; 525/328.8, 375

(56) References Cited

U.S. PATENT DOCUMENTS

| | | | | | |
|---|---|---|---|---|---|
| 4,394,486 | A | * | 7/1983 | Chattha et al. | 525/162 |
| 4,634,738 | A | * | 1/1987 | Santer | 525/162 |
| 4,801,626 | A | * | 1/1989 | Auerbach et al. | 523/208 |
| 5,288,820 | A | * | 2/1994 | Rector, Jr. et al. | 525/510 |
| 5,652,079 | A | * | 7/1997 | Mochizuki et al. | 430/111.1 |
| 5,902,644 | A | * | 5/1999 | Okumura et al. | 427/386 |
| 6,020,433 | A | * | 2/2000 | Hirano et al. | 525/217 |

FOREIGN PATENT DOCUMENTS

| | | | |
|---|---|---|---|
| JP | 54155048 | A | 12/1979 |
| JP | 57040267 | A | 3/1982 |
| JP | 57168255 | A | 10/1982 |
| JP | 58108549 | A | 6/1983 |
| JP | 58177555 | A | 7/1983 |
| JP | 58108548 | A | 8/1983 |
| JP | 59166968 | A | 9/1984 |
| JP | 60186844 | A | 9/1985 |
| JP | 60201360 | A | 10/1985 |
| JP | 62187863 | A | 8/1987 |
| JP | 62262057 | A | 11/1987 |
| JP | 64013560 | A | 1/1989 |
| JP | 02079862 | A | 3/1990 |
| JP | 05216281 | A | 8/1993 |
| JP | 05273789 | A | 10/1993 |
| JP | 06202381 | A | 7/1994 |
| JP | 08006307 | A | 1/1996 |

* cited by examiner

*Primary Examiner*—Janis L. Dote
(74) *Attorney, Agent, or Firm*—Oblon, Spivak, McClelland, Maier & Neustadt, P.C.

(57) ABSTRACT

A carrier for electrophotographic developer, including a core material and a resin layer formed on the surface of the core material, wherein the resin layer has a plastic deformation degree not less than 0.5 $\mu$m and an elastic deformation degree not less than 0.5 $\mu$m. The resin layer is preferably prepared by crosslinking a mixture including an acrylic resin having a reactive hydroxyl group and at least one of a perfectly-alkylated melamine compound and a perfectly-alkylated guanamine compound.

48 Claims, No Drawings

CARRIER FOR ELECTROPHOTOGRAPHIC DEVELOPER, METHOD FOR MANUFACTURING THE CARRIER, AND COATING LIQUID FOR THE METHOD

BACKGROUND OF THE INVENTION

1. Field of the Invention

The present invention relates to a carrier for use in a developer for developing an electrostatic latent image formed by electrophotography, electrostatic printing, electrostatic recording or the like image forming method. More particularly, the present invention relates to a carrier for use in a two-component developer for developing an electrostatic latent image. In addition, the present invention relates to a method for manufacturing the carrier, and coating liquid used for the method.

2. Discussion of the Background

In electrophotography, an image forming method is typically used in which an electrostatic latent image formed on a photoreceptor or an electrostatic recording material using any one of various known methods such as electrophotography, electrostatic printing, electrostatic recording or the like image forming method is developed with a developer to form a visible image. A two component developer in which a carrier and a toner are mixed and agitated so that the carrier and toner are frictionally charged, is typically used as the developer. In this case, a proper amount of a positive or negative charge is imparted to the toner.

Carriers is broadly classified into coated carriers in which the surface of a core material is covered with a cover layer and a non-coated carrier having a core material with no cover layer. In recent years, various coated carriers have been typically used because of having good durability.

Properties requisite for carriers are as follows:

(1) to stably impart proper charge properties such as proper charge quantity and charge quantity distribution to a toner: and (2) to stably maintain good charge properties for a long period of time:

In order to have such requisite properties, it is needed for the carriers to have proper electric properties such as electric resistance. In addition, it is needed for the carriers to have good resistance to changes of environmental conditions such as temperature and humidity, and good resistance to impact and abrasion to stably maintain good charge imparting properties for a long period of time. In attempting to obtain such a good coated carrier, various coated carriers have been proposed.

As to the developing method, methods using a magnetic brush are typically used. Magnetic brush developing methods using a two component developer tend to cause the following problems:

(1) image density decreases due to deterioration of the charge properties of the developer;

(2) images having fogging are produced;

(3) unclear images and/or uneven images are produced because the images include carrier particles (namely the carrier in the developer adheres to an image bearing member as well as the toner in the developer); and (4) the quantity of the carrier decreases due to the carrier adhesion;

The charge properties of a developer including a coated carrier and a toner tend to deteriorate when one or more constituents of the toner in the developer adhere to the cover layer of the coated carrier (this problem is hereinafter referred to as a spent toner problem), or when the cover layer of the coated carrier is peeled therefrom due to stresses which are caused when mixed,.rubbed and fed in a developing unit together with the toner.

In addition, when a coated carrier having an uneven cover layer is used for a developer, the resultant produced images tend to have fogging particularly when a supplemental toner is added to the developer or a toner concentration of the developer is high, or when environmental conditions such as temperature and humidity change. In particular, when one or more constituents of the toner in the developer adheres to the cover layer of the coated carrier, and thereby the surface of the carrier is contaminated (i.e., spent toner problem), the charge properties of the developer deteriorate.

Therefore, in order to develop a developer having a long life, a carrier, which has a proper structure and/or includes a proper material so as not to cause the spent toner problem or so as not to be influenced by the spent toner problem, is needed.

In attempting to avoid such deterioration of charge properties of a developer including a coated carrier and a toner, the following methods have been proposed:

(1) the hardness of the resin layer formed on the carrier is enhanced such that the resin layer so that the cover layer does not peel the carrier surface;

(2) the surface energy of the resin formed on the carrier in the developer is decreased to avoid adhesion of the toner constituents to the carrier surface (i.e., to avoid the spent toner problem); and (3) a combination of the methods (1) and (2).

With respect to the method (1), Japanese Laid-Open Patent Publication No. 62-262057 discloses a carrier in which an iron oxide powder serving as a core material is coated with a resin composition which is produced by crosslinking a copolymer having a carboxyl group and/or a hydroxyl group and a melamine resin, to improve the life of the carrier and to improve the image density. Japanese Laid-Open Patent Publication No. 62-262057 discloses a carrier in which a core material is coated with a resin composition which is produced by crosslinking a thermoplastic resin having a hydroxy group which is not reacted and an alkoxylated melamine resin, to improve fluidity, resistance to high humidity and toner releasability of the resultant carrier. In addition, Japanese Laid-Open Patent Publication No. 2-79862 discloses a carrier in which a core material is coated with a resin composition which is produced by crosslinking an acrylic resin and a melamine resin, to improve durability and weather resistance of the resultant carrier. Further, Japanese Laid-Open Patent Publication No. 5-216281 discloses a carrier in which a core material is coated with an acrylic resin composition which is crosslinked using a melamine formaldehyde resin, to improve durability, heat resistance and weather resistance of the resultant carrier.

However, carriers including a melamine resin have a drawback such that the charge quantity of the carrier decreases under high temperature and high humidity conditions.

With respect to the method (2), Japanese Laid-Open Patent Publications Nos. 60-186844 and 64-13560 have disclosed carriers which are coated with a silicone resin or a fluorine-containing resin, to avoid the spent toner problem. When a silicone resin is used, the silicone resin should be sufficiently crosslinked to avoid the spent toner problem. The sufficiently-crosslinked silicone resin is brittle, and therefore the resin film tends to peel from the coated carrier. If a silicone resin is properly crosslinked, the cover layer is easily abraded, resulting in occurrence of the spent toner problem and deterioration of the charge properties of the carrier when these carriers are used for a long period of time.

Japanese Laid-Open Patent Publication No. 60-201360 discloses a carrier in which a core material is coated with a resin composition in which 100 parts by weight of a resin to be coated is mixed with 0.1 to 20 parts by weight of guanamine, a guanamine derivative, or a guanamine condensation product, to impart good charge imparting ability to the resultant carrier. However, the carrier cannot maintain good charge properties for a long period of time.

In attempting to improve these drawbacks, Japanese Laid-Open Patent Publication No. 8-6307 discloses a carrier which is coated with a thermosetting resin which is produced by crosslinking a guanamine resin and another resin having a functional group which can react with the guanamine resin, wherein the concentration of the guanamine resin is 40% or greater. However, the resistance of the carrier to the spent toner problem is not satisfactory although the resistance of the carrier to changes of environmental conditions and the hardness of the cover layer are good.

Because of these reasons, a need exists for a carrier for an electrophotographic developer, which can maintain good charge imparting ability without causing the spent toner problem even when used for a long period of time.

SUMMARY OF THE INVENTION

Accordingly, an object of the present invention is to provide a carrier useful for an electrophotographic developer, which can maintain good charge imparting ability without causing the spent toner problem even when used for a long period of time.

Briefly this object and other objects of the present invention as hereinafter will become more readily apparent can be attained by a carrier including a core material and a resin layer formed on the surface of the core material, wherein the resin layer has a plastic deformation degree not less than 0.5 $\mu$m and an elastic deformation degree not less than 0.5 $\mu$m.

The resin layer is preferably prepared by crosslinking a mixture including at least an acrylic resin having a reactive hydroxyl group and either a melamine compound or guanamine compound, which has an average polymerization degree not greater than 2.

Preferably, the weight ratio of the acrylic resin to the melamine compound is from 50:50 to 90:10, and the weight ratio of the acrylic resin to the guanamine compound is from 60:40 to 90:10. In addition, the hydroxyl value of the acrylic resin is not greater than 150 mgKOH/g, and preferably from 20 to 120 mgKOH/g, when the acrylic resin is used together with the melamine compound. The hydroxyl value of the acrylic resin is not greater than 120 mgKOH/g, and preferably from 20 to 100 mgKOH/g when the acrylic resin is used together with the guanamine compound.

The thickness of the resin layer formed on the core material is preferably from 0.1 to 0.5 $\mu$m.

In addition, the resin layer includes carbon black serving as an electroconductive material.

In another aspect of the present invention, a method for manufacturing a resin coated carrier is provided which includes the steps of coating a core material with a coating liquid including an acrylic resin having a reactive hydroxyl group and either a perfectly-alkylated melamine compound or guanamine compound, which has an average polymerization degree not greater than 2, and crosslinking the coated resin, preferably upon application of heat, to form the resin layer on the surface of the core material.

In yet another aspect of the present invention, a coating liquid for coating a surface of a carrier is provided which includes an acrylic resin having a reactive hydroxyl group and either a perfectly-alkylated melamine compound or guanamine compound, which has an average polymerization degree not greater than 2.

These and other objects, features and advantages of the present invention will become apparent upon consideration of the following description of the preferred embodiments of the present invention.

DETAILED DESCRIPTION OF THE INVENTION

Generally, the present invention provides a carrier which includes a core material, such as ferrite and magnetite, and a resin layer formed on the surface of the core material, wherein the resin layer has a plastic deformation degree not less than 0.5 $\mu$m and an elastic deformation degree not less than 0.5 $\mu$m when the plastic deformation degree and the elastic deformation degree are measured using a Knoop presser.

When a resin layer having a plastic deformation degree not less than 0.5 $\mu$m and an elastic deformation degree not less than 0.5 $\mu$m is used, a soft resin layer having good abrasion resistance can be formed on the surface of a core material, and thereby the resultant carrier has a long life. The plastic deformation degree is preferably not less than 1.5 $\mu$m and the elastic deformation degree is preferably not less than 1.0 $\mu$m. The measuring method of the plastic deformation degree and elastic deformation degree is explained later.

When the plastic deformation degree is too small, the resultant resin layer tends to be easily abraded. In addition, the elastic deformation degree is too small, the resultant resin layer tends to be broken and peeled therefrom when the resin coated carrier particles impact each other. Therefore, a carrier having a long life cannot be obtained.

The resin layer is preferably prepared by crosslinking a mixture including an acrylic resin having a reactive hydroxyl group and either a melamine compound or a guanamine compound, which is perfectly substituted with one or more alkyl groups and which has an average polymerization degree not greater than 2.

In the present invention, the melamine compounds include melamine and melamine derivatives, and guanamine compounds include guanamine and guanamine derivatives.

As melamine compounds, perfectly-alkylated melamine compounds, methylol type melamine compounds, imino type melamine compounds, and methylol/imino type melamine compounds can be exemplified. Among these melamine compounds, the perfectly-alkylated melamine compounds are preferably used in the resin layer formed on the surface of the carrier of the present invention. This is because when such melamine compounds are crosslinked with an acrylic resin, self condensation reaction hardly occurs, and therefore a relatively soft resin layer can be formed. Therefore, the resin layer is hardly abraded and in addition hardly causes the spent toner problem. However, when the reaction temperature is too high, the melamine compounds tend to cause self condensation reaction, resulting in formation of a relatively hard resin layer. Therefore, the reaction temperature is preferably controlled so as not excessively increase. In the present invention, the perfectly-alkylated melamine compounds are defined as melamine compounds in which all amino nitrogens have two alkyl groups attached. In addition, the carbon number of the two alkyl groups of the perfectly-alkylated melamine compounds is preferably not greater than 4.

Imino type melamine compounds are not preferable because the imino type melamine compounds tend to relatively cause self condensation reaction compared to the perfectly-alkylated melamine compounds, resulting in formation of a relatively hard resin layer. Methylol type melamine compounds tend to cause self condensation reaction. In addition, when the methylol type melamine compounds are heated, the compounds cause a reaction in which formaldehyde is produced, and therefore it is not preferable in viewpoint of safety. Further, if the reaction is not perfectly terminated (i.e., there are residual methylol groups), the charge properties of the resultant coated carrier largely depends on environmental changes. The methylol/imino type melamine compounds have both the properties of the methylol type melamine compounds and the imino type melamine compounds.

Suitable perfectly-alkylated melamine compounds for use in the present invention include compounds having the following formula:

(1)

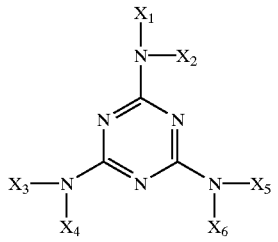

wherein X1 to X6 independently represent a methoxymethyl group, an ethoxymethyl group, and a propoxymethyl group.

(2)

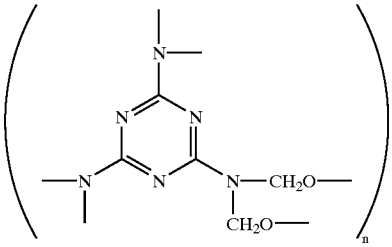

The perfectly-alkylated melamine compounds preferably have an average polymerization degree not greater than 2 to obtain a dense crosslinked structure. When a melamine compound having a high polymerization degree are used, the relatively hard resin layer is formed because the melamine compound having a high polymerization degree has properties similar to those of a melamine compound in which a condensation reaction is progressed.

The perfectly-alkylated melamine compounds for use in the resin layer of the carrier can be prepared by reacting an adduct of 2,4,6-triamino-1,3,5-triazine with formaldehyde with a lower alcohol such as methanol, ethanol, propanol and butanol.

When a perfectly-alkylated melamine compound is used, the resultant resin layer is relatively soft and has a dense crosslinked structure. However, the weight ratio of an acrylic resin to the melamine compound, and the crosslinking temperature are severely controlled. The weight ratio of an acrylic resin having a reactive hydroxyl group to the perfectly-alkylated melamine compound is preferably from 50:50 to 90:10. When the concentration of the melamine compound is too high, the melamine compound tends to cause a self condensation reaction, resulting in formation of a relatively hard resin layer. On the contrary, the concentration of the melamine compound is too low, the crosslinked structure of the resultant resin layer becomes thin, resulting in formation of a resin layer having a low mechanical strength. Therefore the durability of the resultant carrier deteriorates.

Guanamine compounds also include perfectly-alkylated guanamine compounds, methylol type guanamine compounds, imino type guanamine compounds, and methylol/imino type guanamine compounds. Similarly to the case of melamine compounds, the perfectly-alkylated guanamine compounds are preferably used for the resin layer. The reason is the same as that in the case of melamine compounds. In the present invention, the perfectly-alkylated guanamine compounds are defined as guanamine compounds in which all amino nitrogens have two alkyl groups attached. In addition, the carbon number of the perfectly-alkylated guanamine compounds is preferably not greater than 4.

The resin layer formed by an acrylic resin having a hydroxy group and a perfectly-alkylated guanamine compound maintains the softness of an acrylic resin while having a dense crosslinked structure formed by a guanamine compound. Therefore the resin layer is hardly abraded whereas the resin layer is soft. In addition, the resin layer hardly causes the spent toner problem. Similarly to the case using the melamine compound, the crosslinking temperature should be severely controlled to avoid excessive self condensation of the guanamine compound.

Imino type guanamine compounds are not preferable because the imino type guanamine compounds tend to relatively cause self condensation reaction compared to the perfectly-alkylated guanamine compounds, resulting in formation of a relatively hard resin layer. Methylol type guanamine compounds tend to cause self condensation reaction. In addition, when the methylol type guanamine compounds are heated, the compounds cause a reaction in which formaldehyde is produced, and therefore it is not preferable in viewpoint of safety. Further, if the reaction is not perfectly terminated (i.e., there are residual methylol groups), the charge properties of the resultant coated carrier largely depends on environmental changes. The methylol/imino type guanamine compounds have both the properties of the methylol type guanamine compounds and the imino type guanamine compounds.

Suitable perfectly-alkylated guanamine compounds for use in the present invention include guanamine compounds having the following formula:

(3)

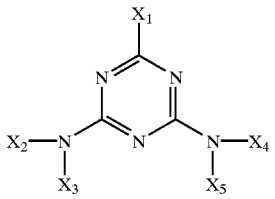

wherein X1 represents an alkyl group or a phenyl group; and X2 to X5 independently represent a methoxymethyl group, an ethoxymethyl group, a propoxymethyl group and a butoxymethyl group.

(4)

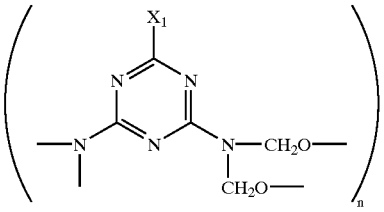

The perfectly-alkylated guanamine compounds preferably have an average polymerization degree not greater than 2 to obtain a dense crosslinked structure. When a guanamine compound having a high polymerization degree is used, the relatively hard and brittle resin layer is formed because the guanamine compound having a high polymerization degree is similar to a guanamine compound in which a condensation reaction is progressed, and the resultant resin layer tends to have a cluster structure.

The perfectly-alkylated guanamine compounds for use in the present invention can be prepared by reacting an adduct of 4,6-diamino-1,3,5-triazine with formaldehyde with a lower alcohol such as methanol, ethanol, propanol and butanol.

When a perfectly-alkylated guanamine compound is used, the resultant resin layer is relatively soft and has a dense crosslinked structure. However, the weight ratio of an acrylic resin to a guanamine compound, and the crosslinking temperature shoul be severely controlled. The weight ratio of an acrylic resin having a reactive hydroxyl group to a perfectly-alkylated guanamine compound is preferably from 60:40 to 90:10. When the concentration of the guanamine compound is too high, the guanamine compound tends to cause a self condensation reaction, resulting in formation of a relatively hard resin layer. On the contrary, the concentration of the guanamine compound is too low, the crosslinked structure of the resultant resin layer becomes thin, resulting in formation of a resin layer having a low mechanical strength. Therefore the durability of the resultant carrier deteriorates.

Acrylic resins for use in the resin layer of the resin coated carrier have to have a functional group capable of reacting with perfectly-alkylated melamine compounds or perfectly-alkylated guanamine compounds.

Among various functional groups, hydroxyl group is the most preferable. Namely, acrylic polymers or copolymers prepared by one or more acrylic monomers having a hydroxyl group can be preferably used in the present invention. Specific examples of such monomers include hydroxyethyl (meth)acrylate, hydroxypropyl (meth)acrylate, hydroxybutyl (meth)acrylate, 1,4-butanediol mono(meth) acrylate, adducts of hydroxyethyl (meth)acrylate with ϵ-caprolactone, adducts of hydroxyethyl (meth)acrylate with ethylene or propylene, and the like monomers.

Other monomers can be used for the acrylic resins for use in the present invention by being copolymerized with one or more of the above-mentioned monomers.

Specific examples of such monomers include (meth) acrylic acid esters such as methyl (meth)acrylate, ethyl (meth)acrylate, propyl (meth)acrylate, n-butyl (meth) acrylate, isobutyl (meth)acrylate, tert-butyl (meth)acrylate, 2-ethylhexyl (meth)acrylate, stearyl (meth)acrylate, tridecyl (meth)acrylate, cyclohexyl (meth)acrylate, phenyl (meth) acrylate, and dimethylaminoethyl (meth)acrylate; other monomers such as styrene, α-methyl styrene, vinyl toluene, acrylonitrile, methacrylonitrile, vinyl acetate, vinyl propionate, acrylamide, methacrylamide, methylolacrylamide, vinyl chloride, propylene, ethylene and the like monomers.

In the present invention, it is preferable to use an acrylic resin having a hydroxyl value not greater than 150 mgKOH/g, and preferably from 20 to 120 mgKOH/g, when the acrylic resin is used together with a perfectly-alkylated melamine compound, to decrease the dependency of the charge properties of the resultant coated carrier on changes of environmental conditions. When an acrylic resin having too high hydroxyl value is used, many hydroxyl groups remain in the resultant resin layer. On the contrary, when an acrylic resin having too low hydroxyl value is used, the crosslinking density decreases, resulting in deterioration of the mechanical strength of the resultant resin layer.

In the present invention, it is preferable to use an acrylic resin having hydroxyl value not greater than 120 mgKOH/g, and preferably from 20 to 100 mgKOH/g, when the acrylic resin is used together with a perfectly-alkylated guanamine compound, to decrease the dependency of the charge properties of the resultant coated carrier on changes of environmental conditions. When an acrylic resin having too large hydroxyl value is used, many hydroxyl groups remain in the resultant resin layer. On the contrary, when an acrylic resin having too low hydroxyl value is used, the crosslinking density decreases, resulting in deterioration of the mechanical strength of the resultant resin layer.

The acrylic resin for use in the present invention can be synthesized by any one of known methods such as solution polymerization, suspension polymerization, bulk polymerization, emulsion polymerization methods and the like methods.

As polymerization initiators, azobisisobutylonitrile, 4,4-azobis(4-cyanopentanoic acid), benzoyl peroxide, t-butylperoxy-2-ethyl hexanoate, cumen hydroperoxide, potassium persulfate, hydrogen peroxide, 2,2'-azobis[2-methyl-N-(2-hydroxyethyl)propioamide] and the like compounds can be used. In addition, dodecyl mercaptan, mercaptoethanol, α-methyl styrene dimers and the like compounds can be used as chain transfer initiators, if desired.

The thickness of the resin layer formed on the carrier of the present invention is preferably from 0.1 to 0.5 μm. By using the materials mentioned above for use in the resin layer, a resin layer having such a thickness can be uniformly formed on a core material. The resin layer formed on the carrier of the present invention has relatively good resistance to abrasion compared to silicone resins conventionally used for resin coated carriers. Therefore, the resin coated carrier of the present invention has a long life even when the formed resin layer is relatively thin. In addition, by forming a relatively thin resin layer on a core material, the resultant carrier has good fluidity, and thereby the spent toner problem can be effectively avoided. However, when the resin layer is too thin, the electric resistance of the resin coated carrier decreases, resulting in occurrence of the spent toner problem.

On the contrary, when the resin layer is too thick, various problems which occur are that the manufacturing costs increase, carrier particles aggregate, and productivity of the coated carrier deteriorates.

By using a perfectly-alkylated melamine compound or guanamine compound having an average polymerization degree not greater than 2 in the resin layer, additives can be easily included in the resin layer. In particular, carbon black can be easily and uniformly dispersed in the resin layer. The reason for good dispersion of carbon black in the resin layer is considered to be that when an acrylic resin, either a melamine compound or a guanamine compound and carbon black are mixed and dispersed to prepare a coating liquid, the melamine compound or guanamine compound is uniformly dispersed in the coating liquid. In addition, the melamine compound or guanamine compound is also uniformly dispersed in the resin layer without reacting with the acrylic resin before being heated.

Since the resin layer of the carrier of the present invention has good abrasion resistance because carbon black is uniformly dispersed in a resin layer, the resin coated carrier can be used for color developers. Therefore, when the carrier is used for a yellow developer, whose color tone is easily changed if an abraded resin layer is mixed in the developer, the color tone hardly changes.

Suitable carbon blacks for use in the resin layer of the carrier includes known carbon black such as furnace black, channel black, acetylene black and the like carbon blacks. A proper carbon black should be selected among these carbon blacks such that the resultant carrier has the requisite properties such as charge properties, electric resistance and the like properties.

Suitable core materials for use in the resin-coated carrier of the present invention include ferrite and magnetite. Ferrite and magnetite having a substantially spherical shape are preferably used as a core material. The particle diameter of the core material is preferably from 20 to 100 $\mu$m. In particular, when it is desired to use a carrier having a small particle diameter, the technique of the present invention can produce good results. Namely, since it is possible to form a thin resin layer on a core material because of having good abrasion resistance, a resin coated carrier having almost the same particle diameter as that of the core material can be prepared.

The resin coated carrier of the present invention can be prepared by any known coating method such as dipping methods and fluidizing methods. The resin coated carrier is then heated at a temperature higher than the crosslinking temperature of the resin. Thus, a resin coated carrier in which the resin is crosslinked can be prepared.

As the coating liquid used for forming the resin layer of the resin coated carrier of the present invention, for example, a solution or a dispersion including a solvent, an acrylic resin, and either a perfectly-alkylated melamine compound or a perfectly-alkylated guanamine compound, and optionally a carbon black, can be used. Such a coating liquid can be uniformly coated on the surface of a core material by any known coating method such as spray coating methods. The coated liquid is dried and crosslinked upon application of heat to form a resin layer having good adhesion and good abrasion resistance. When the coating liquid is coated on the surface of a core material, the resin layer does not crosslink. Therefore it is not needed for the resin layer to be rapidly heat-crosslinking crosslinked soon after the resin layer is coated whereas a silicone resin is needed to be rapidly crosslinked soon after being coated. In addition, since each of the drying process and the crosslinking process can be separately controlled, the qualities of the resin layer can be exactly controlled.

The resin coated carrier of the present invention is used for a two component developer by being mixed with a toner.

The toner for use in the present invention will be explained in detail.

In the present invention, known toners, which include a binder resin and a colorant, can be used as a toner. Specific examples of the binder resin include polymers and copolymers of styrene compounds such as styrene, p-chlorostyrene, and $\alpha$-methyl styrene; $\alpha$-methylene aliphatic monocarboxylic acid esters such as methyl (meth)acrylate, ethyl (meth) acrylate, n-propyl (meth)acrylate, lauryl (meth)acrylate, and 2-ethylhexyl (meth)acrylate; vinylnitriles such as (meth) aocrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone and vinyl isopropenyl ketone; unsaturated hydrocarbons such as ethylene, propylene, isoprene and butadiene; and halogen-containing unsaturated hydrocarbons such as chloroprene. In addition, copolymers prepared by copolymerizing two or more of these monomers, and the mixtures of these polymers and copolymers can be used. Further, non-vinyl condensation resins such as rosin-modified phenyl-formaldehyde resins, epoxy resins, polyester resins, polyurethane resins, polyamide resins, cellulose resins, and polyether resins, and mixtures of these resins and the above-mentioned vinyl resins can also be used.

Suitable colorants for use in the toner include known dyes and pigments. Specific examples of the colorants include carbon black, Nigrosine dyes, iron black, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permaneht Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC) Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The concentration of the colorant in the toner is preferably from 0.1 to 50 parts by weight per 100 parts by weight of the binder resin included in the toner.

The toner for use in the present invention may include a charge controlling agent. As the charge controlling agent, known charge controlling agents can be used. Specific examples of the charge controlling agent include Nigrosine dyes, triphenylmethane dyes, chromium-containing metal complex dyes, chelate pigments of molybdic acid, Rhodamine dyes, alkoxy amines, quaternary ammonium salts (including quaternary ammonium salts modified by fluorine), alkylamides, phosphorous, phosphorous compounds, tungsten, tungsten compounds, fluorine-containing surfactants, salicylic acid metal salts, metal salts of salicylic acid derivatives, and the like compounds. Specifically, the following porducts are exemplified;

Products Manufactured by Orient Chemical Industries Co., Ltd.

BONTRON 03 (Nigrosine dye); BONTRON P-51 (quaternary ammonium salt); BONTRON 5-34 (metal-containing azo dye); E82 (Oxynaphthoic acid metal complex); E-84 (salicylic acid metal salt); and E-89 (phenolic condensation product).

Products Manufactured by Hodogaya Chemical Co., Ltd.

TP-302 and TP-415 (molybdenum complex of quaternary ammonium salt).

Products Manufactured by Hoechst AG

COPY CHARGE PSY VP2038 (quaternary arnmonium salt); COPY BLUE PR (triphenylmethane derivative); and COPY CHARGE NEG VP2036; COPY CHARGE NX VP434.

Products Manufactured by Nippon Carlit Co., Ltd.

LRA-901; and LR+147 (boron complex).

Others

Copper phthalocyanine; perylene, quinacridone, Azo pigments; and polymers having a functional group such as a sulfonate groups a carboxyl group, and a quaternary ammonium group.

These compounds can be used alone or in combination.

The concentration of the charge controlling agent in the toner for use in the present invention is determined depending on the quantity of main charge controlling agent added in the toner, the species of the binder resin used, whether other additives are present, and the method for manufacturing the toner including the dispersion method. In general, the concentration is from 0.1 to 10 parts by weight, and preferably from 0.3 to 5 parts by weight, per 100 parts by weight of the binder resin included in the toner.

In addition, additives such as offset preventing agents, fluidity improving agents, cleaning agents and transfer improving agents may be added in the toner, if desired. Specific examples of such fluidity improving agents include silica, titania, and alumina. Specific examples of such cleaning agents and transfer improving agents include polystyrene particles, polymethyl methacrylate particles, particles, and polyvinylidene fluoride particles. These additives are typically used as external additives. Among these additives, hydrophobic silica having an average primary particle diameter of from 5 to 30 nm is preferably used.

Specific examples of the offset preventing agent include low molecular polypropylene, low molecular polyethylene, and waxes. Preferably low molecular polypropylene having a weight average molecular weight of from 500 to 5,000 is preferably used. The particle diameter of the toner is preferably from 5 to 12 $\mu$m, and more preferably from 5 to 10 $\mu$m, to prepare images having good resolution.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Carrier Coated with a First Resin Composition

Toner Preparation Example 1

The following components were mixed and kneaded upon application of heat.

| | |
|---|---|
| Styrene-n-butyl methacrylate resin | 100 |
| Carbon black (Tradenamed as MA#8 and manufactured by Mitsubishi Chemical Corp.) | 8 |
| Charge controlling agent (Tradenamed as SPIRON BLACK TRH and manufactured by Hodogaya Chemical Co., Ltd.) | 3 |
| Offset preventing agent (Tradenamed as BISCOL 550P and manufactured by Sanyo Chemical Industries Ltd.) | 3 |

The kneaded mixture was cooled, and then pulverized and classified to prepare mother toner particles having an average particle diameter of 7.5 $\mu$m.

Seven tenth (0.7) parts by weight of a hydrophobic silica tradenamed as R-972 and manufactured by Nippon Aerosil Co. were added to 100 parts by weight of the mother toner particles. They were mixed with a Henshel mixer to prepare a black toner for evaluating carriers mentioned later.

Toner Preparation Example 2

The following components were mixed and kneaded upon application of heat.

| | |
|---|---|
| Polyester resin (number average molecular weight (Mn) of 3850, ratio of weight average molecular weight (Mw) to Mn, Mw/Mn, of 7.0, glass transition temperature of 62° C., softening point of 125° C., and acid value of 15 mgKOH/g) | 100 |
| Yellow pigment (tradenamed as NOVOPERM YELLOW P-HG and manufactured by Clariant Japan K.K.) | 5 |
| Zinc salicylate (tradenamed as BONTRON E-84 and manufactured by Orient Chemical Industries Co., Ltd.) | 1.5 |

The kneaded mixture was cooled, and then pulverized and classified to prepare mother toner particles having an average particle diameter of 7.5 $\mu$m.

Seven tenth (0.7) parts by weight of a hydrophobic silica tradenamed as HDK-2000H and manufactured by Clariant Japan K.K. were added to 100 parts by weight of the mother toner particles, and they were mixed to prepare a yellow toner for evaluating carriers mentioned later.

Preparation of Carrier and Developer

Example 1

Preparation of Acrylic Resin Having a Hydroxyl Group

Seven hundred (700) grams of xylene and 300 g of n-butanol were contained in a flask under a nitrogen gas flow, while being agitated with a stirrer. Then the mixture was heated to 100° C.

Then the following mixture was added into the mixture in the flask drop by drop while spending 5 hours until the mixture were entirely added therein.

| | |
|---|---|
| Styrene | 400 g |
| Methyl methacrylate | 160 g |
| Isobutyl methacrylate | 110 g |
| Normal butyl methacrylate | 200 g |
| Methacrylic acid | 30 g |

-continued

| | |
|---|---|
| 2-hydroxyethyl acrylate | 100 g |
| Initiator (azobisisobutylonitrile) | 10 g |

The mixture was further reacted for 6 hours. Thus an acrylic resin having a solid content of about 50% was prepared. The hydroxyl value and number average molecular weight of the resin were 41 mgKOH/g and 14,000, respectively.

Preparation of Resin Coated Carrier

Then the following components were mixed to prepare a coating liquid.

| | |
|---|---|
| Perfectly-methylated melamine (average polymerization degree of 1.70 and solid content of 100%) | 2 |
| Acrylic resin prepared above (solid content of 50 %) | 10 |
| Toluene | 300 |

One thousand (1000) parts by weight of a Cu—Zn ferrite having an average particle diameter of 50 $\mu$m, which is tradenamed as F-300 and manufactured by POWDERTECH Co. LTD., were coated with the thus prepared coating liquid by spray coating using a fluidized bed type coating apparatus while the temperature was controlled at about 60° C. After spray coating, the resin coated carrier was dried for about 10 minutes.

Then the coated carrier was subjected to a heat treatment at 150° C. for 1 hour in an electric furnace. Then the resin coated carrier was cooled and subjected to a treatment to release aggregated carrier particles. Thus, a carrier having a resin layer of 0.2 $\mu$m thereon was prepared.

Preparation of Developer

The thus prepared carrier was mixed with the black toner prepared in Toner Preparation Example 1 using a TURBULA mixer such that the toner concentration was 4% by weight. Thus, a developer of Example 1 was prepared.

Comparative Example 1

Preparation of Coated Carrier

The following components were mixed to prepare a coating liquid.

| | |
|---|---|
| Silicone resin (Tradenamed as SR-2411 and manufactured by Dow Corning Toray Silicone Co., Ltd.) | 150 |
| Toluene | 150 |

One thousand (1000) parts by weight of a Cu—Zn ferrite having an average particle diameter of 50 $\mu$m, which is tradenamed as F-300 and manufactured by POWDERTECH Co. LTD., were coated with the thus prepared coating liquid by spray coating using a fluidized bed type coating apparatus while the temperature was controlled at about 80° C. After spray coating, the coated carrier was dried for about 10 minutes.

Then the coated carrier was subjected to a heat treatment at 200° C. for 2 hour in an electric furnace. Then the coated carrier was cooled and subjected to a treatment to release aggregated carrier particles. Thus, a carrier having a resin layer of 0.8 $\mu$m thereon was prepared.

Preparation of Developer

The thus prepared carrier was mixed with the black toner prepared in Toner Preparation Example 1 using a TURBULA mixer such that the toner concentration was 4% by weight. Thus, a developer of Comparative Example 1 was prepared.

Example 2

Preparation of Coated Carrier

The procedure for preparation of the resin coated carrier in Example 1 was repeated except that the formulation of the coating liquid was changed as follows.

| | |
|---|---|
| Perfectly methylated melamine (average polymerization degree of 1.70 and solid content of 100%) | 3.5 |
| Acrylic resin prepared in Example 1 (hydroxyl value of 41 mgKOH/g and solid content of 50%) | 7 |
| Toluene | 300 |

Thus a resin coated carrier of Example 2 was prepared.

Preparation of Developer

The procedure for preparation of the developer in Example 1 was repeated except that the resin coated carrier was replaced with the resin coated carrier of Example 2 to prepare a developer of Example 2.

Example 3

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 1.70 and solid content of 100%) | 0.7 |
| Acrylic resin prepared in Example 1 (hydroxyl value of 41 mgKoH/g and solid content of 50%) | 12.6 |
| Toluene | 300 |

Thus a resin coated carrier of Example 3 was prepared.

Preparation of Developer

The procedure for preparation of the developer in Example 1 was repeated except that the resin coated carrier was replaced with the resin coated carrier of Example 3 to prepare a developer of Example 3.

Example 4

Preparation of Acrylic Resin

The procedure for synthesis of the acrylic resin in Example 1 was repeated except that the quantity of 2-hydroxyethyl acrylate was increased to prepare another acrylic resin having a hydroxyl value of 147 mgKOH/g and a solid content of 50%.

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 1.70 and solid content of 100%) | 2 |

-continued

| | |
|---|---|
| Acrylic resin prepared above (hydroxyl value of 147 mgKOH/g and solid content of 50%) | 10 |
| Toluene | 300 |

Thus a resin coated carrier of Example 4 was prepared.

Preparation of Developer

The procedure for preparation of the developer in Example 1 was repeated except that the resin coated carrier was replaced with the resin coated carrier of Example 4 to prepare a developer of Example 4.

Example 5

Preparation of Acrylic Resin

The procedure for synthesis of the acrylic resin in Example 1 was repeated except that the quantity of 2-hydroxyethyl acrylate was increased to prepare another acrylic resin having a hydroxyl value of 116 mgKOH/g and a solid content of 50%.

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 1.70 and solid content of 100%) | 2 |
| Acrylic resin prepared above (hydroxyl value of 116 mgKOH/g and solid content of 50%) | 10 |
| Toluene | 300 |

Thus a resin coated carrier of Example 5 was prepared.

Preparation of Developer

The procedure for preparation of the developer in Example 1 was repeated except that the resin coated carrier was replaced with the resin coated carrier of Example 5 to prepare a developer of Example 5.

Example 6

Preparation of Acrylic Resin

The procedure for synthesis of the acrylic resin in Example 1 was repeated except that the quantity of 2-hydroxyethyl acrylate was decreased to prepare another acrylic resin having a hydroxyl value of 28 mgKOH/g and a solid content of 50%.

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 1.70 and solid content of 100%) | 2 |
| Acrylic resin prepared above (hydroxyl value of 28 mgKOH/g and solid content of 50%) | 10 |
| Toluene | 300 |

Thus a resin coated carrier of Example 6 was prepared.

Preparation of Developer

The procedure for preparation of the developer in Example 1 was repeated except that the resin coated carrier was replaced with the resin coated carrier of Example 6 to prepare a developer of Example 6.

Example 7

Preparation of Acrylic Resin

The procedure for synthesis of the acrylic resin in Example 1 was repeated except that the quantity of 2-hydroxyethyl acrylate was decreased to prepare another acrylic resin having a hydroxyl value of 15 mgKOH/g and a solid content of 50%.

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 1.70 and solid content of 100%) | 2 |
| Acrylic resin prepared above (hydroxyl value of 15 mgKOH/g and solid content of 50%) | 10 |
| Toluene | 300 |

Thus a resin coated carrier of Example 7 was prepared.

Preparation of Developer

The procedure for preparation of the developer in Example 1 was repeated except that the resin coated carrier was replaced with the resin coated carrier of Example 7 to prepare a developer of Example 7.

Example 8

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 1.70 and solid content of 100%) | 2 |
| Acrylic resin prepared in Example 1 (hydroxyl value of 41 mgKOH/g and solid content of 50%) | 10 |
| Carbon black (Tradenamed as PRINTEX 90 and manufactured by Degussa AG) | 0.1 |
| Toluene | 300 |

The coating liquid was prepared by mixing the components listed above with a homomixer for 10 minutes.

Thus a resin coated carrier of Example 8 was prepared.

Preparation of Developer

The thus prepared coated carrier was mixed with the yellow toner prepared in Toner Preparation Example 2 using a TURBULA mixer such that the toner concentration was 6% to prepare a developer of Example 8.

Comparative Example 2

Preparation of Coated Carrier

The procedure for preparation of the coated carrier in Example 1 was repeated except that the formulation of the coating liquid was changed as follows.

| | |
|---|---|
| Perfectly-methylated melamine (average polymerization degree of 2.30 and solid content of 100%) | 2 |
| Acrylic resin prepared in Example 1 (hydroxyl value of 41 mgKOH/g and | 10 |

-continued

| | |
|---|---|
| solid content of 50%) | |
| Toluene | 300 |

Thus a resin coated carrier of Comparative Example 2 was prepared.

Preparation of Developer

The procedure for preparation of the developer in Example 1 was repeated except that the resin coated carrier was replaced with the resin coated carrier of Comparative Example 2 to prepare a developer of Comparative Example 2.

Example 9

Preparation of Coated Carrier

The procedure for preparation of the coated carrier in Example 1 was repeated except that the formulation of the coating liquid was changed as follows.

| | |
|---|---|
| Perfectly methylated melamine (average polymerization degree of 1.70 and solid content of 100%) | 4 |
| Acrylic resin (hydroxyl value of 41 mgKOH/g and solid content of 50%) | 6 |
| Toluene | 300 |

Thus a resin coated carrier of Example 9 was prepared.

Preparation of Developer

The procedure for preparation of the developer in Example 1 was repeated except that the resin coated carrier was replaced with the resin coated carrier of Example 9 to prepare a developer of Example 9.

Example 10

Preparation of Coated Carrier

The procedure for preparation of the coated carrier in Example 1 was repeated except that the formulation of the coating liquid was changed as follows.

| | |
|---|---|
| Perfectly methylated melamine (average polymerization degree of 1.70 and solid content of 100%) | 0.35 |
| Acrylic resin prepared in Example 1 (hydroxyl value of 41 mgKOH/g and solid content of 50%) | 13.3 |
| Toluene | 300 |

Thus a resin coated carrier of Example 10 was prepared.

Preparation of Developer

The procedure for preparation of the developer in Example 1 was repeated except that the resin coated carrier was replaced with the resin coated carrier of Example 10 to prepare a developer of Example 10.

Example 11

Preparation of Acrylic Resin

The procedure for synthesis of the acrylic resin in Example 1 was repeated except that the quantity of 2-hydroxyethyl acrylate was increased to prepare another acrylic resin having a hydroxyl value of 163 mgKOH/g and a solid content of 50%.

Preparation of Coated Carrier

The procedure for preparation of the coated carrier in Example 1 was repeated except that the formulation of the coating liquid was changed as follows.

| | |
|---|---|
| Perfectly methylated melamine (average polymerization degree of 1.70 and solid content of 100%) | 2 |
| Acrylic resin prepared above (hydroxyl value of 163 mgKOH/g and solid content of 50%) | 10 |
| Toluene | 300 |

Thus a resin coated carrier of Example 11 was prepared.

Preparation of Developer

The procedure for preparation of the developer in Example 1 was repeated except that the resin coated carrier was replaced with the resin coated carrier of Example 1I1 to prepare a developer of Example 11.

Example 12

Preparation of Developer

The resin coated carrier prepared in Example 1 was mixed with the yellow toner prepared in Toner Preparation Example 2 using a TURBULA mixer such that the toner concentration in the developer was 6%. Thus, a developer of Example 12 was prepared.

Evaluation Method

1. Plastic Deformation Degree and Elastic Deformation Degree

Each of the resins used for preparing the resin coated carriers in Examples 1 and 13 and Comparative Example 1 was also coated on an aluminum plate to form a resin layer having a thickness of 5 $\mu$m. In addition, the resin layer was subjected to the same heat treatment as performed in Example 1.

The degrees of plastic deformation and elastic deformation of the thus prepared resin layer were measured using Dynamic Ultramicroscopic Hardness Tester (Tradenamed as DUH-201 and manufactured by Shimazu Corp.). The measuring conditions are as follows:

(1) Test mode: Mode 2 (Load-unload test)

(2) Presser: Knoop (3) Load: 5 gf (4) Load speed: 5

(5) Retention time: 5 seconds (in maximum load state)

The measurements were performed three times to obtain the average value of each of the plastic deformation degree and elastic deformaition degree.

The results are shown in Table 1.

TABLE 1

| | Plastic deformation degree ($\mu$m) | Elastic deformation degree ($\mu$m) |
|---|---|---|
| Example 1 | 0.978 | 0.657 |
| Example 13 | 1.506 | 1.057 |
| Comparative Example 1 | 0.412 | 0.395 |

2. Abrasion of Coated Resin Layer

Each of the developers of Examples 1 and 13 and Comparative Example 1 was set in a copier (modified IMAGIO MF250 manufactured by Ricoh Co., Ltd.), and subjected to a running test in which 10,000 images were produced. After the running test, the resin coated carrier was observed using a scanning electron microscope whether the coated resin was abraded.

As a result, abrasion was not observed in the resin layer of the carriers of Examples 1 and 13, but abrasion was observed in the resin layer of the carrier of Comparative Example 1.

In addition, each of the developers of Examples 1 to 7, Comparative Example 2, and Examples 9–11 was set in the copier (modified IMAGIO MF250 manufactured by Ricoh Co., Ltd.) and subjected to a running test in which 50,000 images were produced. After the running test, the resin coated carrier was observed using a scanning electron microscope to determine whether the coated resin was abraded.

The results are shown in Table 2.

3. Image Qualities (1) Each of the developers of Examples 1 to 7, Comparative Example 2, and Examples 9–11 was set in the copier (modified IMAGIO MF250 manufactured by Ricoh Co., Ltd.). Images were produced under various environmental conditions to evaluate stability of the developer when environmental conditions are changed.

The results are also shown in Table 2.

(2) Each of the developers of Example 8 and Example 12 was set in color copier (PRETER 550 manufactured by Ricoh Co., Ltd.), and subjected to a running test in which 1,000 images were produced. Color tones of the yellow images before and after the running test were measured with respect to each of the developers. The measuring method is as follows:

Measuring instrument: X-RITE 938

Properties to be evaluated: L, a*, b*

Color tone was measured with respect to an image having an image density of about 1.0.

The results are shown in Table 3.

TABLE 2

| | Resin used for coating | | | Stability against changes of environmental conditions | After running test | |
|---|---|---|---|---|---|---|
| | P.D.[1)] | A:M ratio[2)] | H.V.[3)] | | Q/M[4)] (μc/g) | Abrasion |
| Ex. 1 | 1.7 | 5:2 | 41 | Excellent | −24 | Hardly abraded |
| Ex. 2 | 1.7 | 1:1 | 41 | Good | −19 | Hardly abraded |
| Ex. 3 | 1.7 | 9:1 | 41 | Excellent | −17 | Partially abraded |
| Ex. 4 | 1.7 | 5:2 | 147 | Acceptable | −21 | Hardly abraded |
| Ex. 5 | 1.7 | 5:2 | 116 | Good | −22 | Hardly abraded |
| Ex. 6 | 1.7 | 5:2 | 28 | Excellent | −19 | Partially abraded |
| Ex. 7 | 1.7 | 5:2 | 15 | Excellent | −17 | Partially abraded |
| Comp. Ex. 2 | 2.3 | 5:2 | 41 | Excellent | −12 | Hardly abraded |
| Ex. 9 | 1.7 | 3:4 | 41 | Acceptable | −15 | Hardly abraded |
| Ex. 10 | 1.7 | 9.5:0.5 | 41 | Excellent | −11 | Seriously abraded |
| Ex. 11 | 1.7 | 5:2 | 163 | Bad | −21 | Hardly abraded |

[1)]P.D.: Polymerization degree of perfectly-alkylated melamine resin used
[2)]A:M ratio: Weight ratio of acrylic resin to melamine resin
[3)]H.V.: Hydroxyl value of acrylic resin used
[4)]Q/M: Charge quantity of the developer per 1 gram of toner The absolute value of the charge quantity is preferably not less than 15 μc/g to avoid a toner scattering problem and not to produce images having background fouling.

The deterioration of charge quantity of a carrier occurs for the following reasons:

(1) the coated resin of the carrier is abraded; and (2) toner adheres to the coated resin of the carrier (i.e., the so-called spent-toner phenomenon).

In Table 2, there are cases in which the charge quantity of the developer is not decreased although there is no abrasion of the coated resin, such as the developers of The Comparative Example 2 and Example 9. In such cases, the deterioration of charge quantity is caused by the spent toner phenomenon.

As can be understood from Table 2, carriers having good durability and stability against changes of environmental conditions can be prepared by using a specified acrylic resin and melamine resin and by specifying the polymerization degree of the melamine resin, the ratio of the acrylic resin to the melamine resin, and the hydroxyl value of the acrylic resin.

TABLE 3

| | Before running test | | | After running test | | |
|---|---|---|---|---|---|---|
| | L | a* | b* | L | A* | b* |
| Ex. 8 | 87.22 | −9.12 | 67.88 | 87.51 | −8.98 | 68.02 |
| Ex. 12 | 86.89 | −8.88 | 67.98 | 87.45 | −9.02 | 68.10 |

Carrier Coated with a Second Resin Composition

Toner Preparation Example 3

The following components were mixed and kneaded upon application of heat.

| | |
|---|---|
| Styrene-n-butyl methacrylate resin | 100 |
| Carbon black (Tradenamed as MA#8 and manufactured by Mitsubishi Chemical Corp.) | 8 |
| Charge controlling agent (Tradenamed as SPIRON BLACK TRH and manufactured by Hodogaya Chemical Co., Ltd.) | 3 |
| Offset preventing agent (Tradenamed as BISCOL 550p and manufactured by Sanyo Chemical Industries Ltd.) | 3 |

The kneaded mixture was cooled, and then pulverized and classified to prepare mother toner particles having an average particle diameter of 7.5 μm.

Seven tenth (0.7) parts by weight of a hydrophobic silica tradenamed as R-972 and manufactured by Nippon Aerosil Co. were added to 100 parts by weight of the mother toner particles, and the mixture was mixed with a Henshel mixer to prepare a black toner for evaluating carriers mentioned later.

Toner Preparation Example 4

The following components were mixed and kneaded upon application of heat.

| | |
|---|---|
| Polyester resin (number average molecular weight (Mn) of 3850, ratio of weight average molecular weight (Mw) to Mn, Mw/Mn, of 7.0, glass transition temperature of 62° C., softening point of 125° C., and acid value of 15 mgKOH/g) | 100 |
| Yellow pigment (tradenamed as NOVOPERM YELLOW P-HG and manufactured by Clariant Japan K.K.) | 5 |

-continued

| | |
|---|---|
| Zinc salicylate (tradenamed as BONTRON E-84 and manufactured by Orient Chemical Industries Co., Ltd.) | 1.5 |

The kneaded mixture was cooled, and then pulverized and classified to prepare mother toner particles having an average particle diameter of 7.5 μm.

Seven tenth (0.7) parts by weight of a hydrophobic silica tradenamed as HDK-2000H and manufactured by Clariant Japan K.K. were mixed with 100 parts by weight of the mother toner particles, to prepare a yellow toner for evaluating carriers mentioned later.

Preparation of Carrier and Developer

Example 13

Preparation of Coated Carrier

Then the following components were mixed to prepare a coating liquid.

| | |
|---|---|
| Perfectly-methylated benzoguanamine (average polymerization degree of 1.65 and solid content of 77%) | 2.6 |
| Acrylic resin prepared in Example 1 (hydroxyl value of 41 mgKOH/g and solid content of 50%) | 10 |
| Toluene | 300 |

One thousand (1000) parts by weight of a Cu—Zn ferrite having an average particle diameter of 50 μm, which is tradenamed as F-300 and manufactured by POWDERTECH Co. LTD., were coated with the thus prepared coating liquid by spray coating using a fluidized bed type coating apparatus while the temperature was controlled at about 60° C. After spray coating, the coated carrier was dried for about 10 minutes.

Then the coated carrier was subjected to a heat treatment at 150° C. for 1 hour in an electric furnace. Then the resin coated carrier was cooled and subjected to a treatment to release aggregated carrier particles. Thus, a carrier having a resin layer of 0.2 μm thereon was prepared.

Preparation of Developer

The thus prepared carrier was mixed with the black toner of Toner Preparation Example 3 using a TURBULA mixer such that the toner concentration was 4% by weight to prepare a developer of Example 13.

Example 14

Preparation of Coated Carrier

The procedure for preparation of the coated carrier in Example 13 was repeated except that the formulation of the coating liquid was changed as follows.

| | |
|---|---|
| Perfectly methylated benzoguanamine (average polymerization degree of 1.65 and solid content of 77%) | 3.6 |
| Acrylic resin prepared in Example 1 (hydroxyl value of 41 mgKOH/g and solid content of 50%) | 8.4 |
| Toluene | 300 |

Thus, a resin coated carrier of Example 14 was prepared.

Preparation of Developer

The procedure for preparation of the developer in Example 13 was repeated except that the coated carrier was replaced with the resin coated carrier of Example 14. Thus, a developer of Example 14 was prepared.

Example 15

Preparation of Coated Carrier

The procedure for preparation of the coated carrier in Example 13 was repeated except that the formulation of the coating liquid was changed as follows.

| | |
|---|---|
| Perfectly methylated benzoguanamine (average polymerization degree of 1.65 and solid content of 77%) | 0.9 |
| Acrylic resin prepared in Example 1 (hydroxyl value of 41 mgKOH/g and solid content of 50%) | 12.6 |
| Toluene | 300 |

Thus a resin coated carrier of Example 15 was prepared.

Preparation of Developer

The procedure for preparation of the developer in Example 13 was repeated except that the coated carrier was replaced with the resin coated carrier of Example 15. Thus, a developer of Example 15 was prepared.

Example 16.

Preparation of Acrylic Resin

The procedure for preparation of the acrylic resin in Example 1 was repeated except that the quantity of 2-hydroxyethyl acrylate was increased to prepare an acrylic resin having a hydroxyl value of 147 mgKOH/g.

Preparation of Coated Carrier

The procedure for preparation of the coated carrier in Example 13 was repeated except that the formulation of the coating liquid was changed as follows.

| | |
|---|---|
| Perfectly methylated benzoguanamine (average polymerization degree of 1.65 and solid content of 77%) | 2.6 |
| Acrylic resin prepared in Example 1 (hydroxyl value of 147 mgKOH/g and solid content of 50%) | 10 |
| Toluene | 300 |

Thus a resin coated carrier of Example 16 was prepared.

Preparation of Developer

The procedure for preparation of the developer in Example 13 was repeated except that the coated carrier was replaced with the resin coated carrier of Example 16. Thus, a developer of Example 16 was prepared.

Example 17

Preparation of Acrylic Resin

The procedure for preparation of the acrylic resin in Example 1 was repeated except that the quantity of 2-hydroxyethyl acrylate was increased to prepare an acrylic resin having a hydroxyl value of 116 mgKOH/g.

Preparation of Coated Carrier

The procedure for preparation of the coated carrier in Example 13 was repeated except that the formulation of the coating liquid was changed as follows.

| | |
|---|---|
| Perfectly-methylated benzoguanamine (average polymerization degree of 165 and solid content of 77%) | 2.6 |
| Acrylic resin prepared in Example 1 | 10 |

-continued

| | |
|---|---|
| (hydroxyl value of 116 mgKOH/g and solid content of 50%) | |
| Toluene | 300 |

Thus a resin coated carrier of Example 17, was prepared.

Preparation of Developer

The procedure for preparation of the developer in Example 13 was repeated except that the coated carrier was replaced with the resin coated carrier of Example 17. Thus, a developer of Example 17 was prepared.

Example 18

Preparation of Acrylic Resin

The procedure for preparation of the acrylic resin in Example 1 was repeated except that the quantity of 2-hydroxyethyl acrylate was decreased to prepare an acrylic resin having a hydroxyl value of 28 mgKOH/g.

Preparation of Coated Carrier

The procedure for preparation of the coated carrier in Example 13 was repeated except that the formulation of the coating liquid was changed as follows.

| | |
|---|---|
| Perfectly-methylated benzoguanamine (average polymerization degree of 1.65 and solid content of 77%) | 2.6 |
| Acrylic resin prepared in Example 1 (hydroxyl value of 28 mgKOH/g and solid content of 50%) | 10 |
| Toluene | 300 |

Thus a resin coated carrier of Example 18 was prepared.

Preparation of Developer

The procedure for preparation of the developer in Example 13 was repeated except that the coated carrier was replaced with the resin coated carrier of Example 18. Thus, a developer of Example 18 was prepared.

Example 19

Preparation of Acrylic Resin

The procedure for preparation of the acrylic resin in Example 1 was repeated except that the quantity of 2-hydroxyethyl acrylate was decreased to prepare an acrylic resin having a hydroxyl value of 15 mgKOH/g.

Preparation of Coated Carrier

The procedure for preparation of the coated carrier in Example 13 was repeated except that the formulation of the coating liquid was changed as follows.

| | |
|---|---|
| Perfectly-methylated benzoguanamine (average polymerization degree of 1.65 and solid content of 77%) | 2.6 |
| Acrylic resin prepared in Example 1 (hydroxyl value of 15 mgKOH/g and solid content of 50%) | 10 |
| Toluene | 300 |

Thus a resin coated carrier of Example 19 was prepared.

Preparation of Developer

The procedure for preparation of the developer in Example 13 was repeated except that the coated carrier was replaced with the resin coated carrier of Example 19. Thus, a developer of Example 19 was prepared.

Example 20

Preparation of Coated Carrier

The procedure for preparation of the coated carrier in Example 13 was repeated except that the formulation of the coating liquid was changed as follows.

| | |
|---|---|
| Perfectly-methylated benzoguanamine (average polymerization degree of 1.65 and solid content of 77%) | 2.6 |
| Acrylic resin prepared in Example 1 (hydroxyl value of 41 mgKOH/g and solid content of 50%) | 10 |
| Carbon black (Tradenamed as Printex 90 and manufactured by Degussa AG) | 0.1 |
| Toluene | 300 |

The coating liquid was prepared by mixing the components listed above with a homomixer for 10 minutes.

Thus a resin coated carrier of Example 20 was prepared.

Preparation of Developer

The thus prepared coated carrier was mixed with the yellow toner of Toner Preparation Example 4 using a TURBULA mixer such that the toner concentration was 6% to prepare a developer of Example 20.

Comparative Example 3

Preparation of Coated Carrier

The procedure for preparation of the coated carrier in Example 13 was repeated except that the formulation of the coating liquid was changed as follows.

| | |
|---|---|
| Perfectly-butylated benzoguanamine (average polymerization degree of 3.00 and solid content of 70%) | 2.9 |
| Acrylic resin prepared in Example 1 (hydroxyl value of 41 mgKOH/g and solid content of 50%) | 10 |
| Toluene | 300 |

Thus a resin coated carrier of Comparative Example 3 was prepared.

Preparation of Developer

The procedure for preparation of the developer in Example 13 was repeated except that the coated carrier was replaced with the resin coated carrier of Comparative Example 3 to prepare a developer of Comparative Example 3.

Example 21

Preparation of Coated Carrier

The procedure for preparation of the coated carrier in Example 13 was repeated except that the formulation of the coating liquid was changed as follows.

| | |
|---|---|
| Perfectly-methylated benzoguanamine (average polymerization degree of 1.65 and solid content of 77%) | 4.55 |
| Acrylic resin prepared in Example 1 (hydroxyl value of 41 mgKOH/g and solid content ot 50%) | 7 |
| Toluene | 300 |

Thus a resin coated carrier of Example 21 was prepared.

Preparation of Developer

The procedure for preparation of the developer in Example 1 was repeated except that the coated carrier was replaced with the resin coated carrier of Example 21 to prepare a developer of Example 21.

Example 22

Preparation of Coated Carrier

The procedure for preparation of the coated carrier in Example 13 was repeated except that the formulation of the coating liquid was changed as follows.

| | |
|---|---|
| Perfectly-methylated benzoguanamine (average polymerization degree of 1.65 and solid content of 77%) | 0.46 |
| Acrylic resin prepared in Example 1 (hydroxyl value of 41 mgKOH/g and solid content ot 50%) | 13.3 |
| Toluene | 300 |

Thus a resin coated carrier of Example 22 was prepared.

Preparation of Developer

The procedure for preparation of the developer in Example 1 was repeated except that the coated carrier was replaced with the resin coated carrier of Example 22 to prepare a developer of Example 22.

Example 23

Preparation of Acrylic Resin

The procedure for synthesis of the acrylic resin in Example 13 was repeated except that the quantity of 2-hydroxyethyl acrylate was increased to prepare another acrylic resin having a hydroxyl value of 163 mgKOH/g and a solid content of 50%.

Preparation of Coated Carrier

The procedure for preparation of the coated carrier in Example 1 was repeated except that the formulation of the coating liquid was changed as follows.

| | |
|---|---|
| Perfectly-methylated benzoguanamine (average polymerization degree of 1.65 and solid content of 77%) | 2.6 |
| Acrylic resin prepared above | 10 |

-continued

| | |
|---|---|
| (hydroxyl value of 163 mgKOH/g and solid content ot 50%) | |
| Toluene | 300 |

Thus a resin coated carrier Example 23 was prepared.

Preparation of Developer

The procedure for preparation of the developer in Example 1 was repeated except that the coated carrier was replaced with the resin coated carrier of Example 23 to prepare a developer of Example 23.

Example 24

Preparation of Developer

The resin coated carrier prepared in Example 13 was mixed with the yellow toner of Toner Preparation Example 4 using a TURBULA mixer such that the toner concentration in the developer was 6% to prepare a developer of Example 24.

Evaluation Method

Each of the developers of Examples 13 to 19 and 21 to 23, and Comparative Example 3 was evaluated by the above-mentioned evaluation methods.

The results are shown in Tables 4 and 5.

TABLE 4

| | Resin used for coating | | | Stability against changes of | After running test | |
|---|---|---|---|---|---|---|
| | P.D.[1)] | A:M ratio[2)] | H.V.[3)] | environmental conditions | Q/M[4)] (μc/g) | Abrasion |
| Ex. 13 | 1.7 | 5:2 | 41 | Excellent | −24 | Hardly abraded |
| Ex. 14 | 1.7 | 3:2 | 41 | Excellent | −19 | Hardly abraded |
| Ex. 15 | 1.7 | 9:1 | 41 | Excellent | −18 | Partially abraded |
| Ex. 16 | 1.7 | 5:2 | 147 | Acceptable | −23 | Hardly abraded |
| Ex. 17 | 1.7 | 5:2 | 116 | Good | −22 | Hardly abraded |
| Ex. 18 | 1.7 | 5:2 | 28 | Excellent | −20 | Partially abraded |
| Ex. 19 | 1.7 | 5:2 | 15 | Excellent | −17 | Partially abraded |
| Comp. Ex. 3 | 2.3 | 5:2 | 41 | Excellent | −12 | Partially abraded |
| Ex. 21 | 1.7 | 1:1 | 41 | Acceptable | −14 | Partially abraded |
| Ex. 22 | 1.7 | 9.5:0.5 | 41 | Excellent | −9 | Seriously abraded |
| Ex. 23 | 1.7 | 5:2 | 163 | Bad | −21 | Hardly abraded |

As can be understood from Table 4, carriers having good durability and stability against changes of environmental conditions can be prepared by using a specified acrylic resin and benzoguanamine resin and by specifying the average polymerization degree of the benzoguanamine resin, the ratio of the acrylic resin to the benzoguanamine resin, and the hydroxyl value of the acrylic resin.

TABLE 5

| | Before running test | | | After running test | | |
|---|---|---|---|---|---|---|
| | L | A* | b* | L | a* | b* |
| Ex. 20 | 87.22 | −8.94 | 67.98 | 87.35 | −9.03 | 68.22 |
| Ex. 24 | 86.89 | −8.88 | 67.98 | 87.45 | −9.02 | 68.10 |

As can be understood from the above-description, the resin coated carrier of the present invention has good durability and stability against changes of environmental conditions. In addition, even when carbon black is included in the coated resin to impart good charge properties to a toner used in a developer in combination with the carrier, the carrier hardly deteriorate the color tone of the resultant color images.

This document claims priority and contains subject matter related to Japanese Patent Applications Nos. 11-298893, 11-298890 and 11-298891, all filed on Oct. 20, 1999, and 12-069690 filed on Mar. 14, 2000, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A carrier for electrophotographic developer, comprising a core material and a resin layer on a surface of the core material, wherein the resin layer comprises a crosslinked resin prepared by crosslinking a mixture comprising an acrylic resin having a reactive hydroxyl group and a perfectly-alkylated melamine or guanamine compound having an average degree of polymerization of not greater than 2, and the resin layer has a plastic deformation degree not less than 0.5 $\mu$m and an elastic deformation degree not less than 0.5 $\mu$m.

2. The carrier according to claim 1, wherein said mixture comprises said acrylic resin having a reactive hydroxyl group and a perfectly-alkylated melamine compound, and said acrylic resin and said perfectly-alkylated melamine compound are present in the mixture in a ratio of from 50:50 to 90:10 by weight.

3. The carrier according to claim 1, wherein said mixture comprises said acrylic resin having a reactive hydroxyl group and the perfectly-alkylated melamine compound, and said acrylic resin has a hydroxyl value not greater than 150 mgKOH/g.

4. The carrier according to claim 3 wherein said acrylic resin has a hydroxyl value of from 20 to 120 mgKOH/g.

5. The carrier according to claim 1, wherein said resin layer has a thickness of from 0.1 $\mu$m to 0.5 $\mu$m.

6. The carrier according to claim 1, wherein said resin layer further comprises of from 0.1 to 0.5 $\mu$m.

7. The carrier according to claim 1, wherein said mixture to comprises said acrylic resin having a reactive hydroxyl group and the perfectly-alkylated guanamine compound, and said acrylic resin and said perfectly-alkylated guanamine compound are present in the mixture in a ratio of from 60:40 to 90:10 by weight.

8. The carrier according to claim 1, wherein said mixture comprises said acrylic resin having a reactive hydroxyl group and the perfectly-alkylated guanamine compound, and said acrylic resin has a hydroxyl value not greater than 120 mgKOH/g.

9. The carrier according to claim 8, wherein said acrylic resin has a hydroxyl value of from 20 to 100 mgKOH/g.

10. A carrier for electrophotographic developer, comprising a core material and a resin layer on a surface of the core material, wherein the resin layer comprises a crosslinked resin prepared by crosslinking a mixture comprising an acrylic resin having a reactive hydroxyl group and a perfectly-alkylated melamine compound having an average polymerization degree not greater than 2.

11. The carrier according to claim 10, wherein the acrylic resin and the perfectly-alkylated melamine compound are present in the mixture in a ratio of from 50:50 to 90:10 by weight.

12. The carrier according to claim 10, wherein the acrylic resin has a hydroxyl value not greater than 150 mgKOH/g.

13. The carrier according to claim 12, wherein the acrylic resin has a hydroxyl value of from 20 to 120 mgKOH/g.

14. The carrier according to claim 10, wherein the resin layer has a thickness of from 0.1 $\mu$m to 0.5 $\mu$m.

15. The carrier according to claim 10, wherein the resin layer further comprises a carbon black.

16. A carrier for electrophotographic developer, comprising a core material and a resin layer on a surface of the core material, wherein the resin layer comprises a crosslinked resin prepared by crosslinking a mixture comprising an acrylic resin having a reactive hydroxyl group and a perfectly-alkylated guanamine compound having an average polymerization degree not greater than 2.

17. The carrier according to claim 16, wherein the acrylic resin and the perfectly-alkylated guanamine compound are present in the mixture in a ratio of from 60:40 to 90:10 by weight.

18. The carrier according to claim 16, wherein the acrylic resin has a hydroxyl value not greater than 120 mgKOH/g.

19. The carrier according to claim 18, wherein the acrylic resin has a hydroxyl value of from 20 to 100 mgKOH/g.

20. The carrier according to claim 16, wherein the resin layer has a thickness of from 0.1 $\mu$m to 0.5 $\mu$m.

21. The carrier according to claim 16, wherein the resin layer further comprises a carbon black.

22. A method for manufacturing a carrier for a developer, comprising the steps of:

coating a surface of a core material with a coating liquid comprising an acrylic resin having a reactive hydroxyl group and a perfectly-alkylated melamine compound having an average polymerization degree not greater than 2 to prepare a carrier having a resin layer thereon; and crosslinking the resin layer.

23. The method according to claim 22, wherein the crosslinking step is performed upon application of heat.

24. The method according to claim 22, wherein said acrylic resin and said perfectly-alkylated melamine compound are present in the mixture in a ratio of from 50:50 to 90:10 by weight.

25. The method according to claim 22, wherein said acrylic resin has a hydroxyl value not greater than 150 mgKOH/g.

26. The method according to claim 25, wherein said acrylic resin has a hydroxyl value of from 20 to 120 mgKOH/g.

27. The method according to claim 22, wherein said resin layer has a thickness of from 0.1 $\mu$m to 0.5 $\mu$m.

28. The method according to claim 22, wherein said resin layer further comprises a carbon black.

29. A method for manufacturing a carrier for a developer, comprising the steps of:

coating a surface of a core material with a coating liquid comprising an acrylic resin having a reactive hydroxyl group and a guanamine compound having an average polymerization degree not greater than 2 to prepare a carrier having a resin layer thereon; and crosslinking the resin.

30. The method according to claim 29, wherein the crosslinking step is performed upon application of heat.

31. The method according to claim 29, wherein said guanamine compound is a perfectly-alkylated guanamine compound.

32. The method according to claim 31, wherein said acrylic resin and said perfectly-alkylated guanamine compound are present in the mixture in a ratio of from 60:40 to 90:10 by weight.

33. The method according to claim 29, wherein said acrylic resin has a hydroxyl value not greater than 120 mgKOH/g.

34. The method according to claim 33, wherein said acrylic resin has a hydroxyl value of from 20 to 100 mgKOH/g.

35. The method according to claim 29, wherein said resin layer has a thickness of from 0.1 $\mu$m to 0.5 $\mu$m.

36. The method according to claim 29, wherein said resin layer further comprises a carbon black.

37. A coating liquid for coating a surface of a carrier, comprising an acrylic resin having a reactive hydroxyl group and a hydroxyl value of from 20 to 100 mgKOH/g, and a guanamine compound having an average polymerization degree not greater than 2, wherein the acrylic resin and the guanamine compound are crosslinked upon application of heat.

38. The coating liquid according to claim 37, wherein said guanamine compound is a perfectly-alkylated guanamine compound.

39. The coating liquid according to claim 38, wherein said acrylic resin and said perfectly-alkylated guanamine compound are present in the mixture in a ratio of from 60:40 to 90:10 by weight.

40. An electrophotographic developer, comprising:

a carrier comprising a core material and a resin layer on a surface of the core material, wherein the resin layer comprises a crosslinked resin prepared by crosslinking a mixture comprising an acrylic resin having a reactive hydroxyl group and a perfectly-alkylated melamine or guanamine compound having an average degree of polymerization of not greater than 2, and the resin layer has a plastic deformation degree not less than 0.5 gm and an elastic deformation degree not less than 0.5 $\mu$m;

and a toner.

41. The electrophotographic developer according to claim 40, wherein said mixture comprises said acrylic resin having a reactive hydroxyl group and the perfectly-alkylated melamine compound, and said acrylic resin and the perfectly-alkylated melamine compound are present in the mixture in a ratio of from 50:50 to 90:10 by weight.

42. The electrophotographic developer according to claim 40, wherein said mixture comprises said acrylic resin having a reactive hydroxyl group and the perfectly-alkylated melamine compound, and said acrylic resin has a hydroxyl value not greater than 150 mgKOH/g.

43. The electrophotographic developer according to claim 42, wherein said acrylic resin has a hydroxyl value of from 20 to 120 mgKOH/g.

44. The electrophotographic developer according to claim 40, wherein said resin layer has a thickness of from 0.1 $\mu$m to 0.5 $\mu$m.

45. The electrophotographic developer according to claim 40, wherein said resin layer further to comprises a carbon black.

46. The electrophotographic developer according to claim 40, wherein said mixture comprises a said acrylic resin having a reactive hydroxyl group and the perfectly-alkylated guanamine compound, and said acrylic resin and the perfectly-alkylated guanamine compound are present in the mixture in a ratio of from 60:40 to 90:10 by weight.

47. The electrophotographic developer according to claim 40, wherein said mixture comprises said acrylic resin having a reactive hydroxyl group and the perfectly-alkylated guanamine compound, and said acrylic resin has a hydroxyl value not greater than 120 mgKOH/g.

48. The electrophotographic developer according to claim 47, wherein said acrylic resin has a hydroxyl value of from 20 to 100 mgKOH/g.

* * * * *